US005359748A

United States Patent [19]

Etheridge

[11] Patent Number: 5,359,748

[45] Date of Patent: Nov. 1, 1994

[54] APPARATUS FOR CLEANING THE EXTERIOR OF A PIPE

[75] Inventor: Thomas J. Etheridge, Columbus, Tex.

[73] Assignee: Pipeline Rehab, Inc., Houston, Tex.

[21] Appl. No.: 62,953

[22] Filed: Jan. 15, 1993

[51] Int. Cl.[5] ..... B08B 9/02

[52] U.S. Cl. ..... 15/93.1; 15/104.04; 29/81.1

[58] Field of Search ..... 15/104.04, 93.1, 88; 144/208; 29/81.1, 81.11, 81.02

[56] References Cited

U.S. PATENT DOCUMENTS

| | | | |
|---|---|---|---|
| 2,025,337 | 12/1935 | Camden et al. | 144/208 J |
| 2,641,008 | 6/1953 | Smith | 15/104.04 |
| 2,779,363 | 1/1957 | Laughton | 144/208 J |
| 5,001,801 | 3/1991 | Jarvis et al. | 15/104.04 |

FOREIGN PATENT DOCUMENTS

| | | | |
|---|---|---|---|
| 165091 | 3/1965 | U.S.S.R. | 15/104.04 |

*Primary Examiner*—Edward L. Roberts
*Attorney, Agent, or Firm*—Shlesinger, Arkwright & Garvey

[57] ABSTRACT

The present invention includes a self-propelled-carriage assembly which is mounted on a pipeline for removing deteriorated coating formed thereon. The self-propelled carriage assembly includes a frame having first and second sections. The first section is positioned above and detachably connected to the second section to facilitate placement on and removal from the pipeline. Front and rear rollers are attached to the upper section of the frame for supporting the carriage assembly for movement along the pipeline. A motor is operably associated with at least one of the front and rear rollers for driving the same. A first drive pulley or sprocket is mounted on the upper portion of the frame such that when the carriage is positioned on the pipeline the first pulley is disposed above the pipeline. A second drive pulley or sprocket is mounted on the lower portion of the frame such that when the carriage is positioned on the pipeline the second pulley is disposed below the pipeline. The first pulley is offset from the second pulley along the longitudinal axis of the pipeline. A first endless flexible member travels under the outer surface of the pipeline and over first pulley at a high speed to remove the deteriorated protective coating from the pipeline. A second endless flexible member passes over the outer surface of the pipeline and under the second pulley.

20 Claims, 2 Drawing Sheets

APPARATUS FOR CLEANING THE EXTERIOR OF A PIPE

FIELD OF THE INVENTION

The present invention is directed to an apparatus for rehabilitating the exterior surface of a pipe in a pipeline. More specifically, the present invention is directed to a self-propelled carriage assembly having at least one endless flexible member for cleaning the exterior surface of a pipe in a pipeline.

BACKGROUND OF THE PRESENT INVENTION

Underground pipelines are commonly used throughout the world to transport various materials from one location to another. conventionally, the pipes which eventually form the pipeline system are provided with a protective coating at some point prior to burial. This protective coating deteriorates over time thereby necessitating the removal of the deteriorated coating and application of a new protective coating to prevent the pipeline from being damaged.

Different arrangements for cleaning the exterior surface of a pipe have been previously proposed and implemented. However, those previously employed systems have been fraught with design flaws which sacrifice economies of time, labor and money. Presently available pipe cleaners or pipe coating removers include assemblies which use spring loaded knife blades connected to a rotating ring driven concentrically around the pipe. This system is used to remove coal-tar type coatings. This system is disadvantageous in that, once the coal-tar type coatings become pliable, they tend to build up on the knife blades rendering the blades incapable of effectively removing the deteriorated coating. This results in significant delays while the knife blades are cleaned. Still other systems have required the pipeline to be removed from the burial ditch prior to refabrication of the protective coating.

The present invention is directed to a self-propelled carriage assembly for removing deteriorated coatings on pipelines. The carriage assembly employs a pair of endless flexible members wrapped around the outer surface of the pipe. The endless flexible members travel about the pipe at a high velocity, and preferably in opposite directions and, therefore, the centrifugal force generated frees the deteriorated coating from the chains. This process of freeing the coating material from the chains is further enhanced by the flexing of the flexible members as they travel over the corresponding drive pulleys or sprockets. Thus, the present invention does not encounter significant delays due to build-up on the cleaning tool. This advantage as well as others are obtained by the present invention as will be readily apparent from a review of this specification and accompanying drawings.

OBJECT AND SUMMARY OF THE PRESENT INVENTION

An object of the present invention is to provide an apparatus for cleaning the surface of a pipeline which eliminates the disadvantages attendant known devices.

Another object of the present invention is to provide an apparatus which automatically travels along a pipeline to remove deteriorated protective coatings formed thereon.

A further object of the present invention is to provide an apparatus for cleaning the exterior surface of a pipe which does not encounter build-up on the cleaning tool.

Yet another object of the present invention is to provide an apparatus having at least one high speed endless flexible member to remove deteriorated coatings from the exterior surface of a pipeline.

Still another object of the present invention is to provide an apparatus for removing deteriorated protective coatings from pipes which can traverse the pipeline at relatively high speeds without sacrificing quality of coating removal.

Yet still another object of the present invention is to provide an apparatus for cleaning the exterior surface of a pipeline which is relatively inexpensive both to manufacture and operate.

Still yet another object of the present invention is to provide an apparatus for cleaning the exterior surface of a pipeline which can be operated by both skilled and unskilled labor.

Yet a further object of the present invention is to provide an apparatus for cleaning the exterior surface of a pipe with a cutting tool such as an endless flexible member that acts to remove deteriorated coating along its entire length.

In summary, the present invention includes a self-propelled carriage assembly which is mounted on a pipeline for removing deteriorated coating formed thereon. The self-propelled carriage assembly includes a frame having first and second sections. The first section is positioned above and detachably connected to the second section to facilitate placement on and removal from the pipeline. Front and rear rollers are attached to the upper section of the frame for supporting the carriage assembly for movement along the pipeline. A motor is operably associated with at least one of the front and rear rollers for driving the same. A first drive pulley or sprocket is mounted on the upper portion of ,the frame such that when the carriage is positioned on the pipeline the first pulley is disposed above the pipeline. A second drive pulley or sprocket is mounted on the lower portion of the frame such that when the carriage is positioned on the pipeline the second pulley is disposed below the pipeline. The first pulley is offset from the second pulley along the longitudinal axis of the pipeline. A first endless flexible member travels under the outer surface of the pipeline and over the first drive pulley or sprocket at a high speed to remove the deteriorated protective coating from the upper half of the pipeline. A second endless flexible member passes over the pipeline and under the second pulley or drive sprocket at a high speed to remove the deteriorated coating from the lower half of the pipeline. More specifically, the first and second endless flexible members form first and second loops, respectively, about the pipeline. The first loop passes under the bottom surface and along the side surfaces of the pipeline while the second loop passes over the top surface and along the side surfaces of the pipeline. Hydraulic cylinders may be associated with each of the first and second pulleys to permit independent adjustment of the tension of the first and second loops.

DETAILED DESCRIPTION OF THE DRAWINGS

DETAILED DESCRIPTION OF THE PREFERRED EMBODIMENT

The preferred embodiment of the present invention will now be described with reference made to FIGS. 1 to 3.

Figure 1:
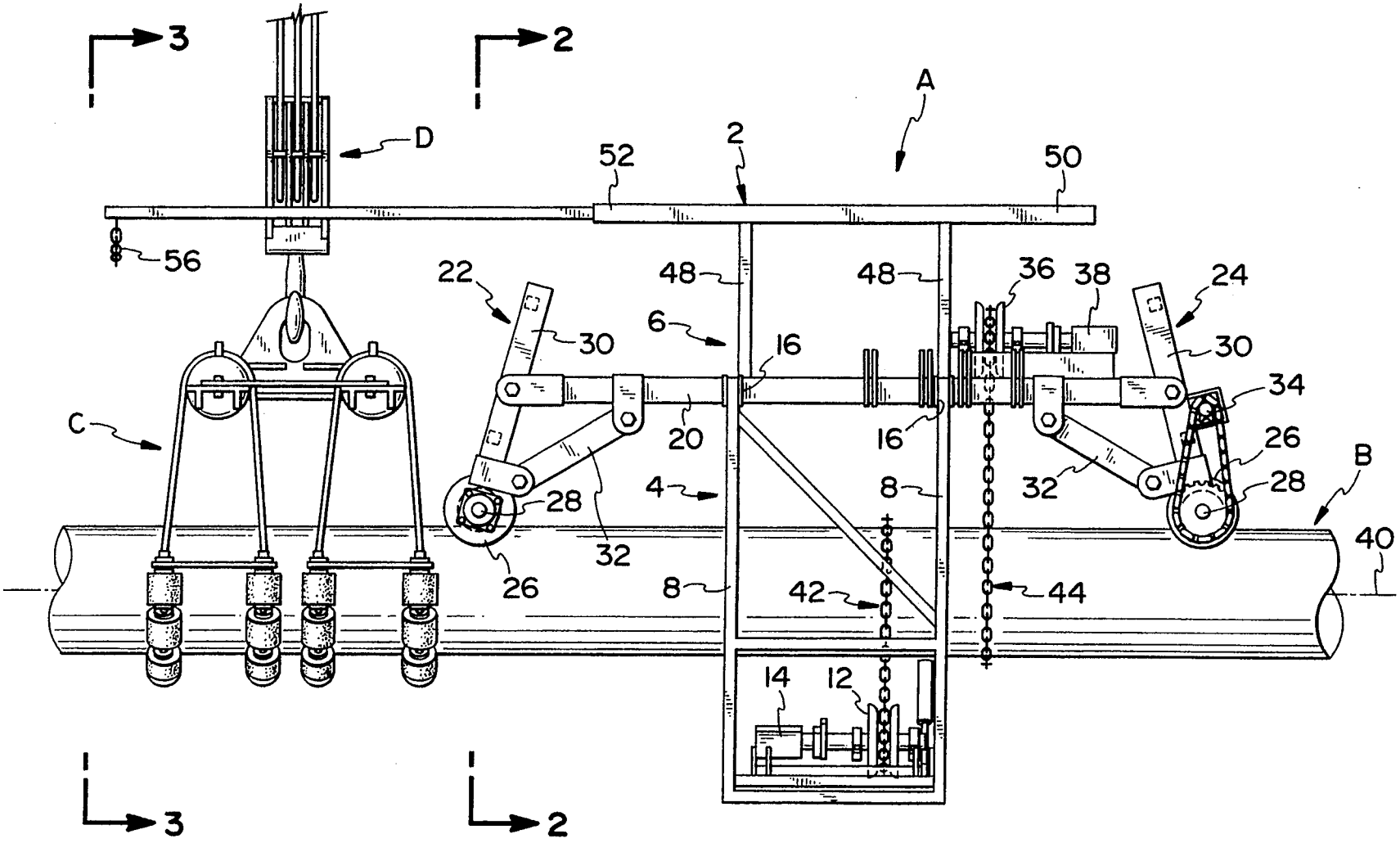
FIG. 1 is a side elevational view of a preferred embodiment of the present invention.
Figure 3:
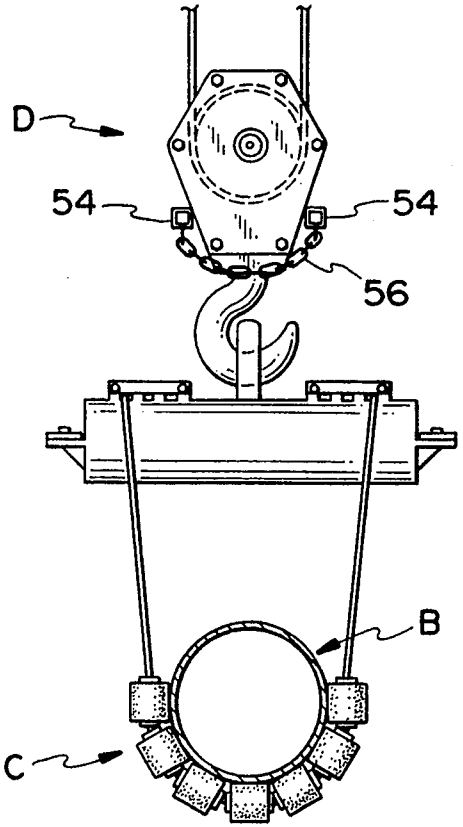
FIG. 3 is a cross-sectional view of the preferred embodiment of FIG. 1 taken along lines 3—3.
Figure 2:
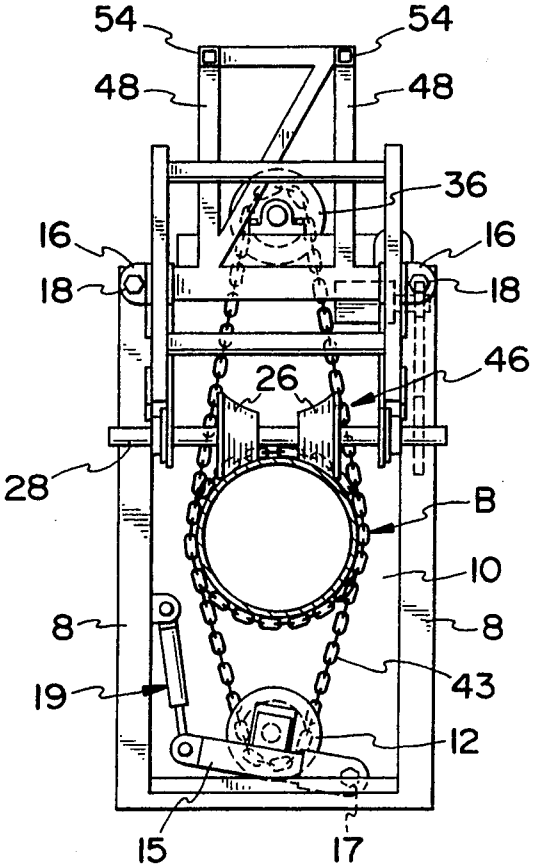
FIG. 2 is a cross-sectional view of the preferred embodiment of FIG. 1 taken along lines 2—2.

FIGS. 1 to 3

Referring to FIG. 1, a self-propelled carriage assembly A is mounted on a section of an underground pipeline B. Although not shown, the carriage assembly A is designed to operate without removing the pipeline from its burial ditch. However, it will be understood that the present invention may be used where the pipeline or a section thereof is positioned adjacent rather than in the burial ditch.

A sling assembly C is positioned about the pipeline B and suspended by a side boom D of a tractor (not shown). In this manner, the section of the pipeline B immediately adjacent the carriage assembly A is disposed above the ground a sufficient distance to enable the carriage assembly to move freely therealong.

The carriage assembly A includes a frame 2 having a lower section 4 detachably connected to an upper section 6. Referring to FIGS. 1 and 2, the lower section 4 includes four vertically extending columns 8. The columns 8 are spaced from each other a sufficient distance to form opening 10 to receive the pipeline B.

Referring to FIG. 2, a drive sprocket or pulley 12, and drive motor 14 are supported on an adjustable platform 15 secured to and extending between vertical columns 8. Referring to FIG. 2, the platform 15 is pivotally mounted about shaft 17. A piston and cylinder arrangement 19, is connected to platform 15, for varying the distance between platform 15 and pipeline B. The drive motor 14 is drivingly connected to the drive pulley or sprocket 12. Preferably, the drive motor 14 is a hydraulic motor. However, any conventional drive motor may be used.

openings are formed in the uppermost portion of columns 8 and are of a size corresponding to the openings formed in brackets 16 extending from the upper section 6 of the frame 2. Pins 18 pass through the openings formed in the uppermost portion of columns 8 and brackets 16 to detachably connect the lower section 4 to the upper section 6 of the frame 2. By forming frame 2 from a lower section 4 which is detachable from the upper section 6, it is possible to readily mount the carriage assembly A on pipeline B. More specifically, as seen in FIG. 2, the lower section 4 is substantially U-shaped. The lower section 4 is fitted about the pipeline B by first inverting it such that the open end of the U-shaped sub-assembly receives the pipeline B. Subsequently, the lower section 4 or sub-assembly is rotated to the position shown in FIG. 1. The upper section 6 of the frame 2 is then mounted to the pipeline B and detachably connected to the lower section 4 by pins 18.

Upper section 6 of frame 2 includes a pair of horizontally extending arms 20. As is seen in FIGS. 1 and 2, brackets 16 are secured to and extend outwardly from arms 20. Wheel assemblies 22 and 24 are secured to opposite ends of arms 20, as seen in FIG. 1. Referring to FIG. 2, wheel assemblies 22 and 24 include a pair of rollers 26 which are adapted to run along the upper surface of the pipeline B. Adjustable collars or other suitable members may be used with rollers 26 mounted on a shaft 28 so that the spacing between the rollers 26 may be varied to accommodate different size pipes. Shafts 28 are supported by substantially rectangularly shaped support members 30 and associated braces 32.

A drive motor 34 is drivingly connected to shaft 28 to drive the rollers 26 mounted thereon. In this manner, the carriage assembly A may be self-propelled along the pipeline B. It will be understood that a drive motor could be attached to wheel assembly 24 or to wheel assembly 22.

A second drive sprocket or pulley 36 and corresponding drive motor 38 are mounted on the upper section of frame 2 between arms 20. The drive motor 38 is preferably a hydraulic motor. However, any suitable drive motor may be used. Referring to FIG. 1, drive pulley 36 is offset from drive pulley 12 along the longitudinal axis 40 of pipeline B.

A first endless flexible member 42 such as a chain passes under drive sprocket or pulley 12 and over the top surface of pipeline B. In this manner, the endless chain 42 forms a loop 43 which engages the upper and side surfaces of pipeline B. A second endless chain 44 passes over drive pulley or sprocket 36 and under the pipeline B. Thus, the second endless chain 44 forms a loop 46 which engages the bottom and side surfaces of the pipeline B. Therefore, the first loop 43 cleans the upper half of the pipeline while the second loop 46 cleans the lower half. As is seen in FIG. 1, the second loop 46 is offset along the longitudinal axis from the first loop 43. This arrangement prevents interference between the flexible members 42 and 44.

The drive motors 14 and 38 drive endless chains 42 and 44 at a high speed through closed paths about the exterior surface of the pipeline B. Since drive motors 14 and 38 are operable independent of each other, the speeds of chains 42 and 44 may be varied relative to each other if desired. The endless chains 42 and 44 do not experience build-up of protective coating thereon. This is due in part to the centrifugal force generated during travel of the chains 42 and 44 which frees any protective coating initially adhered thereto. This is also due to the flexing the chains as they pass through the corresponding drive pulleys 12 and 36.

A hydraulic piston and cylinder assembly (not shown) is also associated with the drive pulley 36 to vary the distance of the pulley 36 relative to the pipeline B. Since the hydraulic piston and cylinder assemblies for pulleys 12 and 36 are operable independent of each other, it is possible to independently adjust the tension of loops 44 and 46.

The endless chains 42 and 44 are formed by master links. By using endless chains, each link at some point engages the outer surface of the pipeline B to remove the deteriorated coating formed thereon.

Four support columns 48 extend upwardly from arms 20 and are secured to the respective horizontally extending members 50. The members 50 are hollow and each have an opening formed at ends 52. square tubing 54 is received in the ends 52. A chain 56 extends between the ends 58 of square tubing 54.

Referring to FIG. 3, the square tubing 54 prevents the side boom D from moving laterally with respect to the carriage assembly A. The chain 56 ensures that the side boom D stays between the square tubing 54.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as may be applied to the central features hereinbefore set forth, and fall within the scope of the invention and of the limits of the appended claims.

I claim:

1. An apparatus for cleaning the exterior of a pipe; comprising:

a) a frame having upper and lower sections, said upper section of said frame being positioned above a pipe to be cleaned when the frame is mounted thereon, said lower section of said frame being positioned below the pipe to be cleaned when the frame is mounted thereon;

b) means operably associated with said frame for supporting said frame for movement on the pipe to be cleaned;

c) a first pulley being secured to the lower section of said frame such that said first pulley is positioned beneath the pipe to be cleaned when said frame is mounted thereon;

d) a second pulley being secured to the upper section of said frame such that said second pulley is positioned above the pipe to be cleaned when said frame is mounted thereon;

e) at least one elongated flexible cleaning member drivingly connected to one of said first and second pulleys and extending around said pipe for cleaning an exterior surface of the pipe; and, f) a drive member drivingly connected to said one of said first and second pulleys to drive said at least one flexible cleaning member to clean the exterior surface of the pipe.

2. An apparatus as in claim 1, wherein:

a) said at least one flexible cleaning member comprises a first endless chain's operably drivingly connected with said first pulley; and b) a second endless chain drivingly connected to said second pulley and extending around said pipe.

3. An apparatus as in claim 2, wherein:

a) said first endless chain traverses a path such that top and side surfaces of the pipe are cleaned thereby, said second endless chain traverses a path such that bottom and side surfaces of the pipe are cleaned thereby, said second endless chain being offset form said first endless chain along a longitudinal axis of the pipe.

4. An apparatus as in claim 1, further including:

a) a second drive member drivingly connected to the other of said first and second pulleys.

5. An apparatus as in claim 4, wherein:

a) said second drive member is operable independent of said first drive member.

6. An apparatus as in claim 1, wherein:

a) said first pulley is offset along a longitudinal axis of the pipe to be cleaned from said second pulley.

7. An apparatus for cleaning the exterior of a pipe; comprising:

a) a frame adapted to be mounted on a pipe to be cleaned;

b) means operably associated with said frame for supporting said frame for movement on the pipe to be cleaned;

c) at least a first endless flexible cleaning member extending around said pipe and adapted to directly engage a surface of the pipe; and, d) drive means operably associated with said frame for moving said endless flexible cleaning member relative to said frame for cleaning an exterior surface of the pipe, said endless flexible cleaning member extending in a first plane, said first plane extending substantially perpendicular to a longitudinal axis of the pipe to be cleaned.

8. An apparatus as in claim 7 wherein:

a) said frame includes first and second sections, said first section is positioned above and detachably connected to said second section for facilitating placement on and removal of said frame from the pipe.

9. An apparatus as in claim 7, wherein:

a) said endless flexible cleaning member is a chain.

10. An apparatus as in claim 7, further including:

a) a second endless flexible cleaning member extending around said pipe;

b) said drive means includes first and second pulleys drivingly connected to said first and second endless flexible cleaning members, respectively.

11. An apparatus as in claim 10, wherein:

a) said first pulley is mounted on said first section and said second pulley is mounted on said second section.

12. An apparatus as in claim 11, wherein:

a) said first and second endless flexible cleaning members extend in first and second planes, respectively, said first plane extends substantially parallel to said second plane.

13. An apparatus as in claim 7, wherein:

a) said drive means includes at least one pulley, said endless flexible cleaning member is received by said at least one pulley.

14. An apparatus for cleaning the exterior of a pipe; comprising:

a) a frame adapted to be mounted on a pipe to be cleaned, said frame having upper, lower, front and rear portions;

b) a first roller being disposed adjacent said front portion of said frame for supporting said frame for movement along the pipe to be cleaned, a second roller being disposed adjacent said rear portion of said frame for supporting the frame for movement along the pipe to be cleaned;

c) drive means operably associated with one of said first and second rollers for automatically moving said frame along the pipe to be cleaned; and d) a first endless flexible cleaning member extending around said pipe and adapted to directly engage a surface of the pipe and a drive operably associated with said frame for moving said endless flexible member relative to said frame for cleaning an exterior surface of the pipe to be cleaned.

15. An apparatus as in claim 14 wherein:

a) said endless flexible cleaning member is a chain which extends around approximately half the outer circumference of the pipe to be cleaned.

16. An apparatus as in claim 14, further including:

a) a second endless flexible cleaning member extending around said pipe;

b) said chain drive includes first and second pulleys, said first pulley is positioned adjacent said lower portion of said frame and said second pulley is positioned adjacent said upper portion of said frame; and, c) said first endless flexible cleaning member passes under said first pulley and said second endless flexible cleaning member passes over said second pulley.

17. An apparatus for cleaning the exterior of a pipe; comprising:

a) a frame adapted to be mounted on a pipe to be cleaned;

b) means operably associated with said frame for supporting said frame on the pipe to be cleaned; and, c) a first endless flexible chain extending around said pipe and adapted to engage an exterior surface of the pipe and a drive operably associated with said frame for moving said endless flexible chain relative to said frame for cleaning only exterior surfaces of the pipe to be cleaned.

18. An apparatus as in claim 17, wherein:

a) said drive includes first and second pulleys, said first pulley is positioned above said second pulley.

19. An apparatus as in claim 18, further including:

a) a second endless flexible cleaning member extending around said pipe;

b) said first endless flexible cleaning member passes over said first pulley and said second flexible cleaning member passes under said second pulley.

20. An apparatus for cleaning the exterior of a pipe; comprising:

a) a frame adapted to be mounted on a pipe to be cleaned;

b) means operably associated with said frame for supporting said frame on the pipe to be cleaned; and, c) an endless flexible cleaning member extending around said pipe and adapted to directly engage the pipe and a drive means operably associated with said frame for moving said endless flexible cleaning member relative to said frame for cleaning the pipe, said endless flexible member forms a first loop which extends above and below the pipe to be cleaned.

* * * * *